US008971747B2

(12) United States Patent
Ogasawara et al.

(10) Patent No.: US 8,971,747 B2
(45) Date of Patent: Mar. 3, 2015

(54) IMAGE FORMING APPARATUS AND METHOD FOR CONTROLLING IMAGE FORMING APPARATUS, WHICH INCLUDES FIXING AND DECOLORIZING SECTION

(71) Applicants: Kabushiki Kaisha Toshiba, Minato-ku, Tokyo (JP); Toshiba Tec Kabushiki Kaisha, Shinagawa-ku, Tokyo (JP)

(72) Inventors: Masato Ogasawara, Tokyo (JP); Koji Imamiya, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/483,360

(22) Filed: Sep. 11, 2014

(65) Prior Publication Data

US 2014/0376939 A1 Dec. 25, 2014

Related U.S. Application Data

(63) Continuation of application No. 13/494,128, filed on Jun. 12, 2012.

(60) Provisional application No. 61/496,699, filed on Jun. 14, 2011.

(51) Int. Cl.
*G03G 15/20* (2006.01)
*G03G 21/20* (2006.01)

(52) U.S. Cl.
CPC ..... *G03G 15/2039* (2013.01); *G03G 21/20* (2013.01)
USPC ..... 399/69; 399/43; 399/341

(58) Field of Classification Search
USPC ..... 399/43, 81, 69, 223, 341
See application file for complete search history.

(56) References Cited

U.S. PATENT DOCUMENTS

| | | | | |
|---|---|---|---|---|
| 5,781,822 | A * | 7/1998 | Nishiyama et al. | 399/1 |
| 6,152,620 | A * | 11/2000 | Ozawa et al. | 400/120.01 |
| 2004/0080787 | A1 | 4/2004 | Kakikawa et al. | |
| 2007/0109586 | A1* | 5/2007 | Yamada et al. | 358/1.14 |
| 2009/0154970 | A1* | 6/2009 | Yoshida et al. | 399/341 |
| 2010/0196063 | A1* | 8/2010 | Iguchi et al. | 399/322 |
| 2010/0290812 | A1* | 11/2010 | Taguchi et al. | 399/223 |
| 2011/0262197 | A1 | 10/2011 | Imamiya et al. | |

FOREIGN PATENT DOCUMENTS

JP 2007-034127 2/2007

OTHER PUBLICATIONS

U.S. Office Action mailed Feb. 20, 2014 for U.S. Appl. No. 13/494,128, filed Jun. 12, 2012.

* cited by examiner

*Primary Examiner* — Francis Gray
(74) *Attorney, Agent, or Firm* — Amin, Turocy & Watson, LLP

(57) ABSTRACT

An image forming apparatus includes a count section configured to count time during which no image forming is performed and a control section configured to allow heating of a heat generating section at temperature for decolorizing after the time counted by the count section reaches the a predetermined threshold time.

10 Claims, 7 Drawing Sheets

IMAGE FORMING APPARATUS AND METHOD FOR CONTROLLING IMAGE FORMING APPARATUS, WHICH INCLUDES FIXING AND DECOLORIZING SECTION

CROSS-REFERENCE TO RELATED APPLICATION

This application is a Continuation of application Ser. No. 13/494,128 filed Jun. 12, 2012, which is based upon and claims the benefit of U.S. Provisional Application No. 61/496,699, filed on Jun. 14, 2011; the entire contents of both of which are incorporated herein by reference.

FIELD

Embodiments described herein relate generally to an image forming apparatus and a method for controlling an image forming apparatus including a fixing and decolorizing section.

BACKGROUND

There are known an image forming apparatus that performs image formation using a decolorizable toner and an erasing device that changes an image from a color developed state to a decolored state. The decolorizable toner used in such an image forming apparatus is decolorized when a color former compound and a color developer are disconnected by heat.

The erasing device is provided separately from the image forming apparatus. However, there is known a fixing device in the image forming apparatus also used as the erasing device taking into account space saving. In general, temperature necessary for decolorizing a toner is higher than temperature necessary for fixing the toner. Therefore, the fixing device also functioning as the erasing device operates as the erasing device by raising the temperature of the fixing device when the fixing device is about to perform an erasing operation.

However, if the temperature of the fixing device is once raised, since the fixing device is formed of a material having high heat accumulation properties such as rubber, it takes time to lower the temperature to the temperature suitable for fixing again. On the other hand, if the fixing is performed in a state in which the temperature does not sufficiently drop, excessive melting of the toner called high-temperature offset occurs. Therefore, even if a user attempts to perform copying or the like while a erasing operation is performed, the user has to wait until the temperature of the fixing device drops, leading to poor operability.

DETAILED DESCRIPTION

According to one embodiment, an image forming apparatus includes, an image forming section configured to form an image on a medium with a decolorizable toner, a fixing and decolorizing section configured to fix the image formed on the medium and to decolorize the image on the medium selectively, a heat generating section configured to heat the fixing and decolorizing section to first temperature during the fixing and to heat the fixing and decolorizing section to second temperature higher than the first temperature during the decolorizing, a count section configured to count time during which the image forming section doesn't perform an image forming after the image formation on the medium is finished through the fixing and a control section configured to control the heat generating section to heat the fixing and decolorizing section to the second temperature, when the time counted by the count section reaches the a predetermined threshold time.

An embodiment is explained below with reference to the accompanying drawings.

Figure 1:
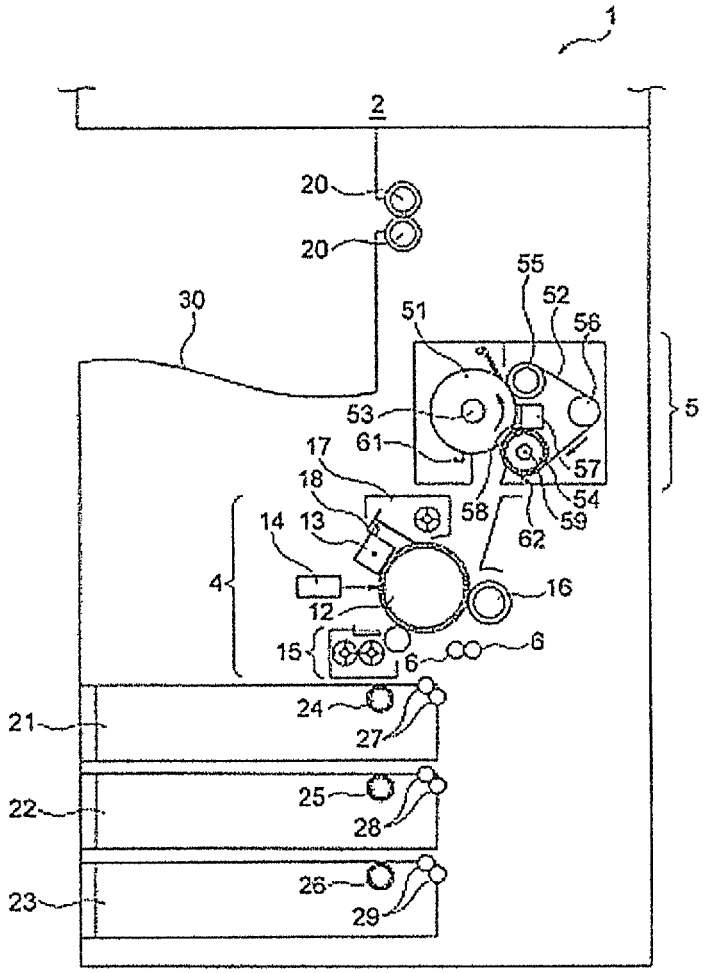
FIG. 1 is a sectional view of an image forming apparatus according to an embodiment.

FIG. 1 is a schematic configuration diagram of an MFP (Multi Function Peripheral) 1, which is an image forming apparatus according to this embodiment. The MFP 1 includes a scanner section 2 that scans an original document during copying or the like and a printer section 4 functioning as an image forming section. The MFP 1 includes, below the printer section 4, paper feeding cassettes 21 and 22 and a recycle paper feeding cassette 23 that store sheets to be fed to the printer section 4. There is provided a fixing and decolorizing device 5 that fixes an image, which is formed by the printer section 4, on a sheet and decolorizes or erases the image fixed thereon. There is provided further a discharging section 30 that discharges the sheet having the image fixed thereon by the fixing and decolorizing device 5 downstream of the printer section 4 along a traveling direction of the sheet.

The printer section 4 includes a rotating photoconductive drum 12. The printer section 4 includes, around the photoconductive drum 12, a charging device 13 that uniformly charges the photoconductive drum 12 to negative polarity and a laser exposure device 14 that irradiates a laser beam, which is based on image data or the like from the scanner section 2, on the charged photoconductive drum 12 and forms an electrostatic latent image on the photoconductive drum 12. The printer section 4 includes a developing device 15 that supplies a toner serving as an image forming material to the electrostatic latent image on the photoconductive drum 12, a transfer device 16 that transfers a toner image formed on the photoconductive drum 12 onto a sheet P, which is an image recording medium, and a cleaner 17 that removes an untransferred toner remaining on the photoconductive drum 12.

The developing device 15 stores a two-component developer, which is a mixture of a toner and a magnetic carrier and supplies the toner to the electrostatic latent image on the photoconductive drum 12. The toner is a toner that is decolorized or erased by being heated to predetermined temperature. This decolorizable toner contains binder resin and a color material. The color material includes a color assuming compound and a color developing agent. When the decolorizable toner is fixed on a sheet, the color assuming compound and the color developing agent combine and develop a predetermined color, for example, blue. On the other hand, if an image formed with the decolorizable toner is heated to temperature higher than temperature during the fixing processing, the color assuming compound and the color developing agent are dissociated. The color assuming compound and the color developing agent lose the color and become invisible on the sheet. As an example, a toner that is fixed at 80° C. to 100° C. and decolorize by being heated to 130° C. to 150° C. is used.

In this embodiment, a capsule type thermal decolorizable toner formed by a chemical method explained below is used as the decolorizable toner.

(1) Binder Resin, WAX Atomized Liquid

Polyester resin was used as the binder resin. Resin atomized liquid was formed using polyester resin, an anion emulsifier, and a neutralizer and using a high-pressure homogenizer.

(2) Preparation of WAX Dispersing Liquid

Atomized liquid was obtained by a method same as the method for the resin using rice WAX.

(3) Preparation of a Toner

Leuko die: CVL (crystal violet lactone), color developing agent; 4-hydroxybenzonic acid benzyl, temperature control agent: lauric acid-4-benzyloxy phenyl ethyl The binder resin, the WAX atomized liquid, the WAX dispersing liquid, and the toner were heated and melted and encapsulated by a well-known coacervation method. The encapsulated color material, toner binder resin dispersing liquid, and WAX dispersing liquid were condensed and fused using aluminum sulfate [Al2(SO4)3] and further cleaned and dried to obtain a toner. Silica and titanium oxide were externally added to the toner.

The explanation is continued with reference to FIG. 1. The paper feeding cassette 21, the paper feeding cassette 22, and the recycle paper feeding cassette 23 have substantially the same configuration. Whereas unused sheets are stored in the paper feeding cassettes 21 and 22, used sheets, i.e., sheets having toner images formed thereon are stored in the recycle paper feeding cassette 23. However, the recycle paper feeding cassette 23 can store unused sheets as well.

The paper feeding cassette 21 includes a pickup roller 24 that feeds a sheet at the top of the sheets stored in the paper feeding cassette 21. A separating and conveying roller 27 is provided to separate two or more sheets, which are fed by the pickup roller 24, one by one and conveys. Like the paper feeding cassette 21, pickup rollers 25 and 26 and separating and conveying rollers 28 and 29 are also respectively provided in the paper feeding cassette 22 and the recycle paper feeding cassette 23.

Figure 4:
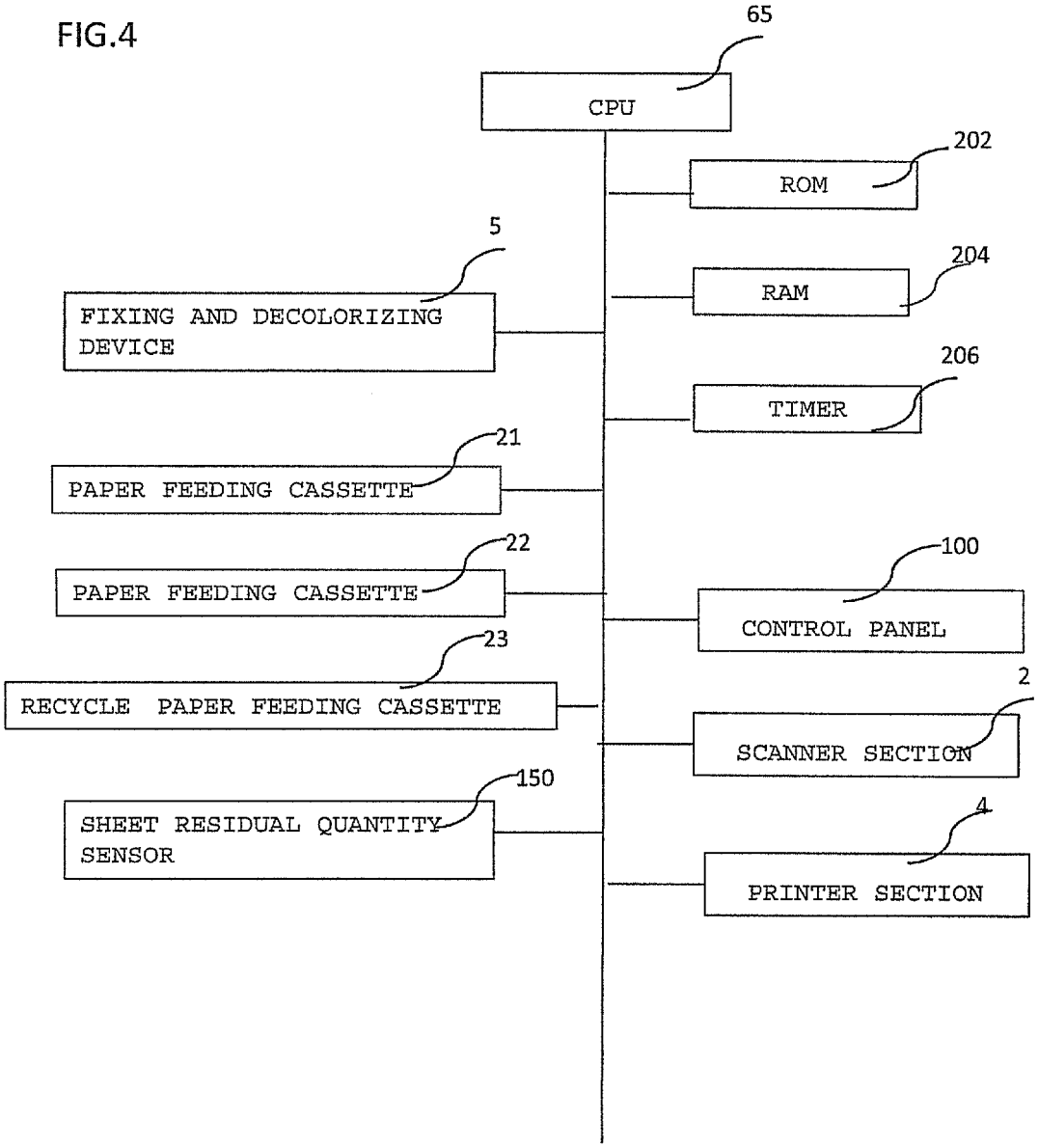
FIG. 4 is a block diagram of the configuration of a control panel of the image forming apparatus.

A sheet residual quantity sensor 150 is provided at the recycle paper feeding cassette 23 as shown in FIG. 4. The sheet residual quantity sensor 150 detects whether the sheets are stored in the recycle paper feeding cassette 23 or not. A sheet residual quantity sensor 150 can also detect whether the sheets stored in the recycle paper feeding cassette are equal to or more than a predetermined threshold quantity or not.

Figure 2:
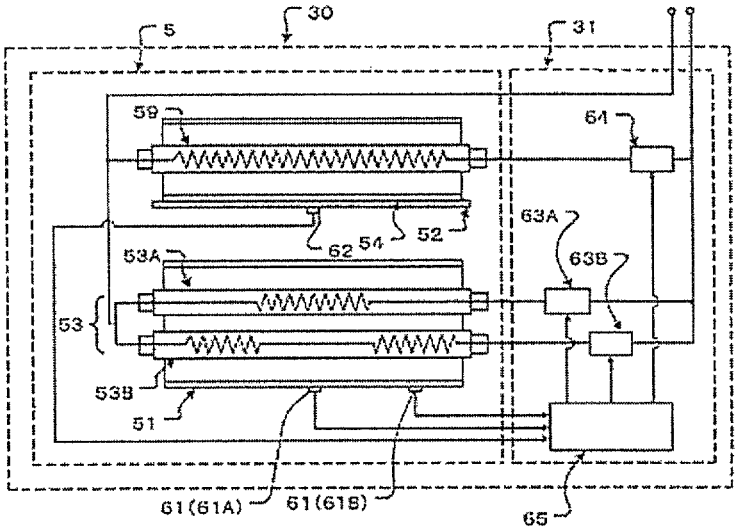
FIG. 2 is a configuration diagram of a fixing and decolorizing device according to the embodiment.

The fixing and decolorizing device 5 includes a heat roller 51, which is a fixing member formed in a cylindrical shape, and a pressurizing belt 52, which is a pressurizing member that endlessly turns. The pressurizing belt 52 comes into contact with the outer circumferential surface of the heat roller 51 over a predetermined range and forms a fixing nip portion. As shown in FIG. 2, the heat roller 51 incorporates, for example, a halogen lamp 53 on the inside as a heating source. The diameter of the heat roller 51 is, for example, 45 mm. The diameter of the pressurizing belt 52 is, for example, equivalent to a diameter of 47 mm in terms of a circle. In this embodiment, the length in a conveying direction of the fixing nip portion is, for example, about 27 mm.

As shown in FIG. 1, the pressurizing belt 52 is looped around a belt heat roller 54 located on an upstream side in the conveying direction, a pressurizing roller 55 located on a downstream side in the conveying direction, and a tension roller 56. The pressurizing belt 52 forms fixing nip portions between the belt heat roller 54 and the pressurizing roller 55. The pressurizing roller 55 brings the pressurizing belt 52 into pressurized contact with the heat roller 51 and forms an outlet of the fixing nip portion. A pressurizing pad 58 is held by a pressurizing pad holder 57 arranged on the inner side of the pressurizing belt 52. The pressurizing pad 58 is pressed against the inner circumferential surface of the pressurizing belt 52 in the center of the fixing nip portion. The pressurizing belt 52 is brought into pressurized contact with the heat roller 51.

The belt heat roller 54 is formed in a hollow roller shape. A halogen lamp 59 is incorporated in the belt heat roller 54.

In this embodiment, the diameter of the belt heat roller 54 is set to 20 mm, the diameter of the pressurizing roller 55 is set to 18 mm, and the width of the pressurizing pad 58 is set to 10 mm.

The surface temperature of the heat roller 51 is detected by a thermistor 61 set in contact with the outer circumferential surface of the heat roller 51. The surface temperature of the pressurizing belt 52 at the belt heat roller 54 is detected by a thermistor 62 set in contact with the outer circumferential surface of the pressurizing belt 52.

The heat roller 51 comes into contact with an unfixed toner image born on a sheet. Therefore, the heat roller 51 includes, for example, a fluorine resin PFA (tetrafluoroethylene perfluoroalkyl vinyl ether copolymer) layer having thickness of about 25 μm as a release layer on a roller substrate made of aluminum having thickness of 1.0 mm. The pressurizing belt 52, which is a pressurizing member, includes a silicone rubber layer having thickness of 200 μm on a belt substrate made of nickel having thickness of about 40 μm and includes a fluorine resin PFA layer having thickness of about 30 μm as a release layer on the silicone rubber layer.

As shown in FIG. 2, the heat roller 51 is driven by a not-shown driving source to rotate. The pressurizing belt 52 is driven to rotate following the heat roller 51.

The halogen lamp 53 incorporated in the heat roller 51 includes two lamps, i.e., a center lamp 53A that heats the center in the length direction of the heat roller 51 and a side lamp 53B that heats both the ends in the length direction of the heat roller 51. The lamp 59 incorporated in the belt heat roller 54 heats the belt heat roller 54 over the entire length in the length direction. The center lamp 53A corresponds to, for example, the sheet width of an A4 portrait size long in the conveying direction. The heat roller side lamp 53B corresponds to, for example, the sheet width of an A4 landscape size long in a direction orthogonal to the conveying direction. The power of these three lamps is, for example, 300 W.

A center lamp switching element 63A, a side lamp switching element 63B, and a pressurizing belt lamp switching element 64 are respectively subjected to ON and OFF control, whereby electricity is supplied from a commercial alternating-current power supply to the center lamp 53A, the side lamp 53B, and the lamp 59.

The center lamp switching element 63A, the side lamp switching element 63B, and the pressurizing belt lamp switching element 64 are subjected to ON and OFF control by a control section 65.

The thermistor 61 includes a center thermistor 61A that detects the surface temperature of the center portion in the elongated direction of the heat roller 51 and a side thermistor 61B that detects the surface temperature of one side end in the elongated direction of the heat roller 51. The thermistor 61 inputs temperature detection information of the center thermistor 61A and the side thermistor 61B to the control section 65. If a sheet on which a toner is fixed is, for example, a sheet of the A4 portrait size, an OFF period of the side lamp 53B is set long to prevent the temperature of both the ends of the heat roller 51 from rising more than necessary.

The thermistor 62 detects the surface temperature of the center portion in the width direction of the pressurizing belt 52 and inputs temperature detection information to the control section 65. The thermistors 61A, 61B, and 62 are connected to the control section 65 respectively via A/D converters not shown.

The set temperature of the heat roller 51 during fixing is 100° C. and the set temperature of the heat roller 51 during decolorizing is 130° C. The set temperature of the pressurizing belt 52 during fixing is 80° C. and the set temperature of the pressurizing belt 52 during decolorizing is 110° C.

The sheet having the toner fixed thereon by the fixing and decolorizing device 5 is nipped by a paper discharge roller pair 20 and discharged to the paper discharge section 30.

Figure 3:
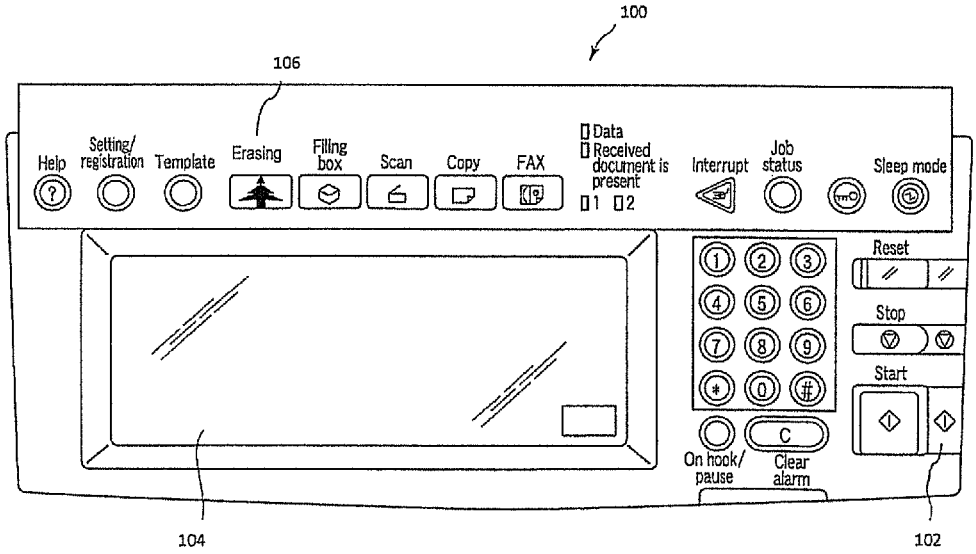
FIG. 3 is an external view of an operation section in the embodiment.

FIG. 3 is an external view of a control panel 100 functioning as an operation section included in the MFP 1. The control panel 100 includes various input keys 102 and a liquid crystal panel 104. The input keys 102 include, besides a start key and a numeric keypad, a decolorizing key 106 pressed by the user when the user desired to perform erasing of a sheet.

A main configuration of a control system of the MFP 1 according to this embodiment is shown in FIG. 4.

The MFP 1 further includes a CPU 65, which is a control section, a ROM 202, a RAM 204, and a timer 206 besides the scanner section 2, the printer section 4, the control panel 100, the paper feeding cassettes 21 and 22, the recycle paper feeding cassette 23 and the sheet residual quantity sensor 150. These sections are connected via a system bus.

The CPU 65 controls the sections connected via the system bus. The ROM 202 has stored therein various control programs necessary for the MFP 1 to operate. The control programs are executed by the CPU 65. The RAM 204 is a memory that temporarily stores data generated during the execution of the control programs. The timer 206 counts time according to the execution of the control programs. The timer 206 counts, for example, an idle time that elapses after the MFP 1 finishes the image formation. In other words, the timer 206 counts time during which the printer section doesn't perform a new image forming operation after the MFP 1 finishes the previous image forming operation.

An image forming process and a decolorizing process by the MFP 1 are explained.

According to the start of the image forming process, in the printer section 4, the photoconductive drum 12 rotating in an arrow s direction at circumferential speed of 215 mm/sec is uniformly charged to −750 V by the charging device 13. A laser beam corresponding to document information is irradiated on the photoconductive drum 12 by the laser exposure device 14 to form an electrostatic latent image on the photoconductive drum 12. Subsequently, the electrostatic latent image is developed by the developing device 15 using the decolorizable toner. A toner image formed of the decolorizable toner is formed on the photoconductive drum 12.

On the other hand, a sheet is fed from the paper feeding cassette 21. The sheet is sent to the transfer device 16 by a registration roller pair 6 in synchronization with the formation of the toner image on the photoconductive drum 12. The toner image on the photoconductive drum 12 is transferred onto the sheet.

The sheet having the toner image transferred thereon is peeled off the photoconductive drum 12 and then sent to the fixing and decolorizing device 5. The surface temperature of the heat roller 51 of the fixing and decolorizing device 5 is controlled to be 100° C. The sheet is inserted through between the heat roller 51 and the pressurizing belt 52. The toner image is heated, pressurized, and fixed on the sheet. After the fixing and decolorizing device 5 finishes the fixing of the toner image formed with the decolorizable toner, the sheet is discharged to the paper discharge section 30 by the paper discharge roller pair 20.

After the transfer ends, a residual toner on the photoconductive drum 12 is cleaned by the cleaner 17. Residual charges on the photoconductive drum 12 are removed by a charge removing LED 18.

Figure 5:
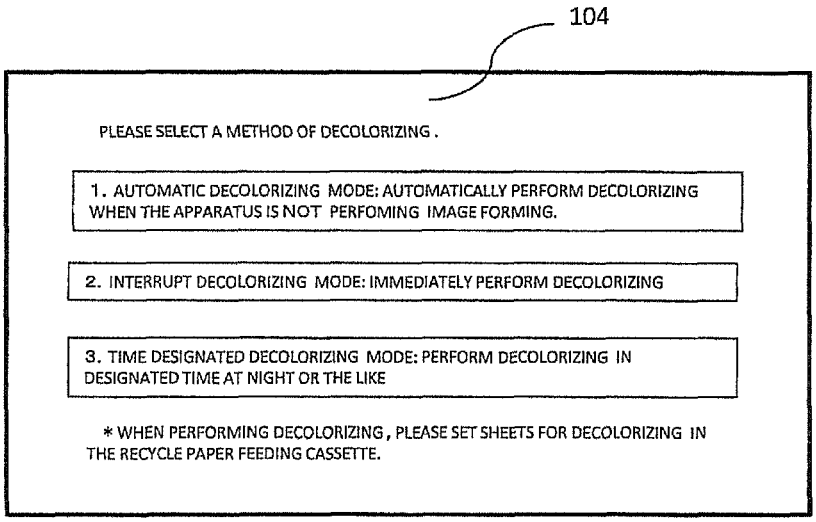
FIG. 5 is a diagram of an example of a screen displayed on a control panel in the embodiment.

The decolorizing process is explained with reference to FIGS. 5 and 6.

When the user presses the decolorizing key 106 of the control panel 100 shown in FIG. 3, the decolorizing process is started. When the user presses the decolorizing key 106, a decolorizing mode setting screen shown in FIG. 5 is displayed on the liquid crystal panel 104.

The decolorizing mode setting screen displays a message for requesting the user to select any one of three modes explained below.

A first mode is an automatic decolorizing mode in which, if MFP 1 does not perform image forming for a fixed time, for example, 30 minutes, the MFP 1 automatically conveys the used sheet from the recycle paper feeding cassette 23 to the fixing and decolorizing device 5 and performs decolorizing in the fixing and decolorizing device 5. If the user selects the automatic decolorizing mode, the user can input, from the liquid crystal panel 104, time from the end of the image forming until shift to a decolorizing mode and change the time. In this embodiment, the time for shift is 30 minutes.

A second mode is an interrupt decolorizing mode for performing decolorizing if the decolorizing is necessary. For example, if the user selects the interrupt decolorizing mode during copying, the decolorizing is started without delay after a copying job ends.

A third mode is a time designated decolorizing mode for designating time when decolorizing is started and time when the decolorizing is finished and performing the decolorizing in a designated period at night or the like.

Not only one mode but also plural modes among the three modes can be selected.

Processing at the automatic decolorizing mode is explained.

Figure 6:
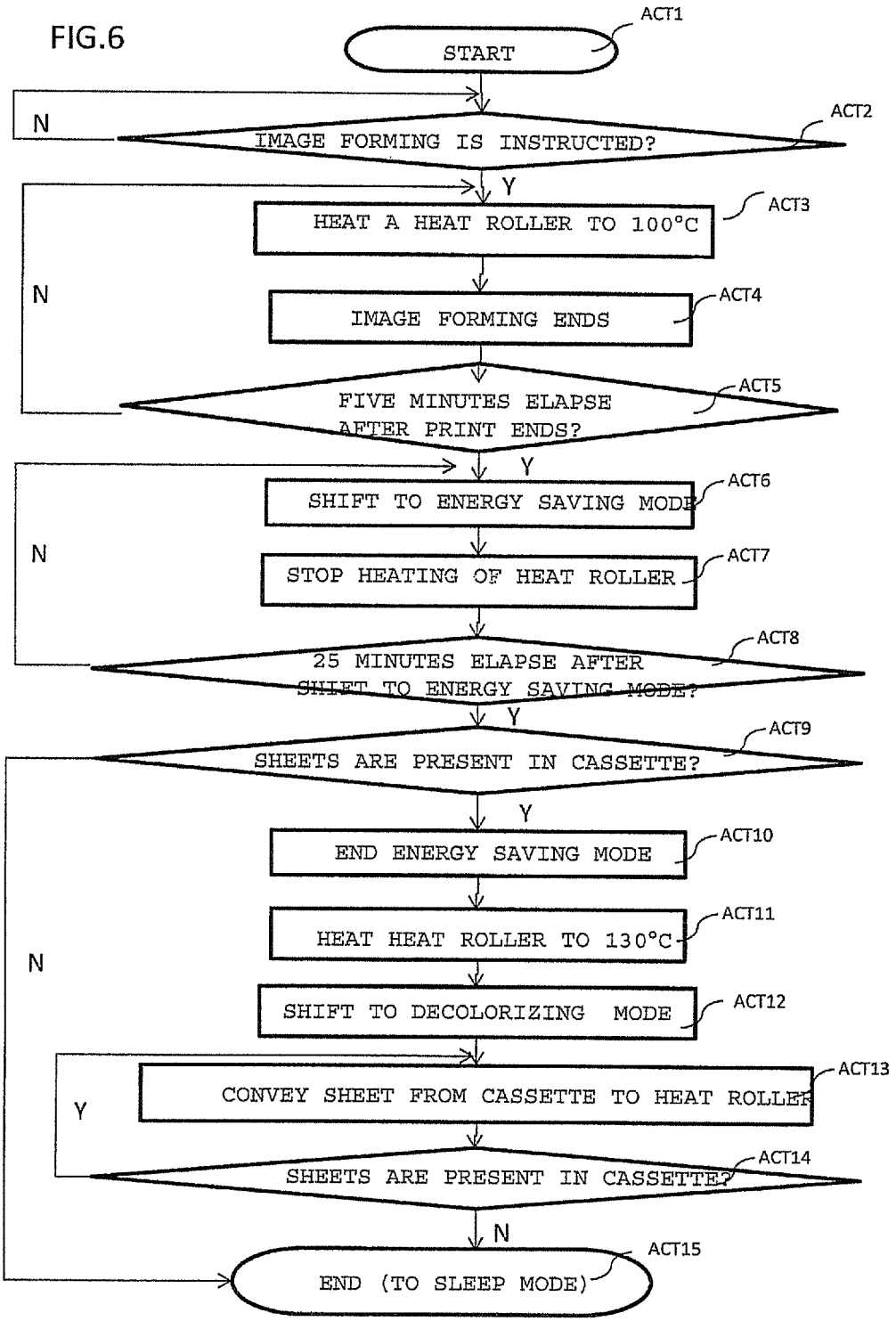
FIG. 6 is a flowchart for a decolorizing operation.

In FIG. 6, when the image formation is instructed in accordance with an image forming signal or a print signal from a not-shown external computer (Y in ACT 2), the CPU 65 sets the surface temperature of the heat roller 51 to 100° C., checks the temperature of the center thermistor 61A, and heats the heat roller 51 on the basis of a result of the check (ACT 3). The CPU 65 also heats the belt heating roller 54 to heat the pressurizing belt 52 to 80° C. When the temperature of the heat roller 51 reaches 100° C. and the temperature of the pressurizing belt 52 reaches 80° C., the CPU 65 shifts to an image print mode and executes the image formation. When a sheet is discharged to the paper discharge section 30, an image forming process ends, and the rotation of the photoconductive drum stops, the timer 206 starts count (ACT 4).

For five minutes after the image forming process ends, the CPU 65 sets the MFP 1 in a ready mode and maintains the surface temperature of the heat roller 51 at 100° C. and maintains the temperature of the pressurizing belt 52 at 80° C. If the CPU 65 determines that five minutes elapses (Y in ACT 5), the CPU 65 ends the ready mode and shifts to an energy saving mode (ACT 6). The energy saving mode is a mode for maintaining the temperature of the heat roller 51 and/or the pressurizing belt 52 lower than temperatures in a fixing mode and the ready mode to lower the temperature of the fixing and decolorizing device 5. In this embodiment, the CPU 65 stops the heating of the heat roller 51 and continues the heating of only the belt heat roller 54 to heat pressurizing belt 52 (ACT 7). The temperature of the pressurizing belt 52 is 80° C.

If twenty-five minutes further elapse after the shift to the energy saving mode while a print signal is not received, i.e., thirty minutes elapse after the print ends (Y in ACT 8), the CPU 65 determines that time during which image formation is not performed exceeds a threshold of 30 minutes set in advance and detects, with a sheet residual quantity sensor 150, whether sheets are stored in the recycle paper feeding cassette 23. As a result of the detection, if the CPU 65 detects that used sheets are stored in the recycle paper feeding cassette 23 (Y in ACT 9), the CPU 65 ends the energy saving mode (ACT 10) and starts heating of the heat roller 51 and the belt heat roller 54 in order to switch the energy saving mode to the automatic decolorizing mode (ACT 11). If sheets are absent in the recycle paper feeding cassette 23 (N in ACT 9), the CPU 65 ends the processing without shifting to the decolorizing mode (ACT 15) and switches the MFP 1 to, as a sleep mode, a mode for stopping the heating of the pressurizing belt 52 as well. In other words, the CPU 65 prohibits a temperature rise of the heat roller 51 if sheets are absent in the recycle paper feeding cassette 23.

The CPU 65 may execute decolorizing processing when the sheets are present in equal to or more than a fixed quantity.

As explained above, according to a detection result of the sheet residual quantity sensor 150, when the CPU 65 detects that a quantity of sheets stored in the recycle paper feeding cassette 23 is less than the fixed quantity, the CPU 65 does not execute the decolorizing mode. In other words, the CPU 65 prohibits the heating of a fixing and decolorizing device earlier when a quantity of sheets stored in the recycle paper feeding cassette 23 is less than the fixed quantity than when a quantity of sheet stored in the recycle paper feeding cassette is equal to or more than the fixed quantity.

When the CPU 65 detects, during the ready mode in five minutes after ending the image forming process (ACT 4), that sheets are absent in the recycle paper feeding cassette 23 or a sheet quantity is less than the fixed quantity, after ending the ready mode, the CPU 65 may immediately shift to the sleep mode without entering the energy saving mode.

If the temperature of the heat roller 51 reaches 130° C. and the temperature of the pressurizing belt 52 reaches 110° C. (ACT 11), the CPU 65 shifts to the automatic decolorizing mode (ACT 12). In the automatic decolorizing mode, the CPU 65 starts conveyance of a used sheet from the recycle paper feeding cassette 23 to the fixing and decolorizing device 5 (ACT 13). At this point, although the photoconductive drum 12 of the printer section 4 rotates, toner image formation on the photoconductive drum 12 is not performed.

The sheet conveyed from the recycle paper feeding cassette 23 via the printer section 4 is heated by the fixing and decolorizing device 5, whereby a toner on the sheet is decolorized. The sheet bearing the decolorized toner is discharged to the paper discharge section 30 by the discharge roller pair 20. If the sheet residual quantity sensor 150 detects that sheets are absent in the recycle paper feeding cassette 23 (N in ACT 14), the CPU 65 ends the automatic decolorizing mode (ACT 15) and enters the sleep mode.

Instead of entering the sleep mode, after ending the decolorizing mode, the CPU 65 may return to the ready mode, and may maintain the heat roller 51 at 100° C. and maintain the pressurizing belt 52 at 80° C. to prepare for the next print.

Figure 7:
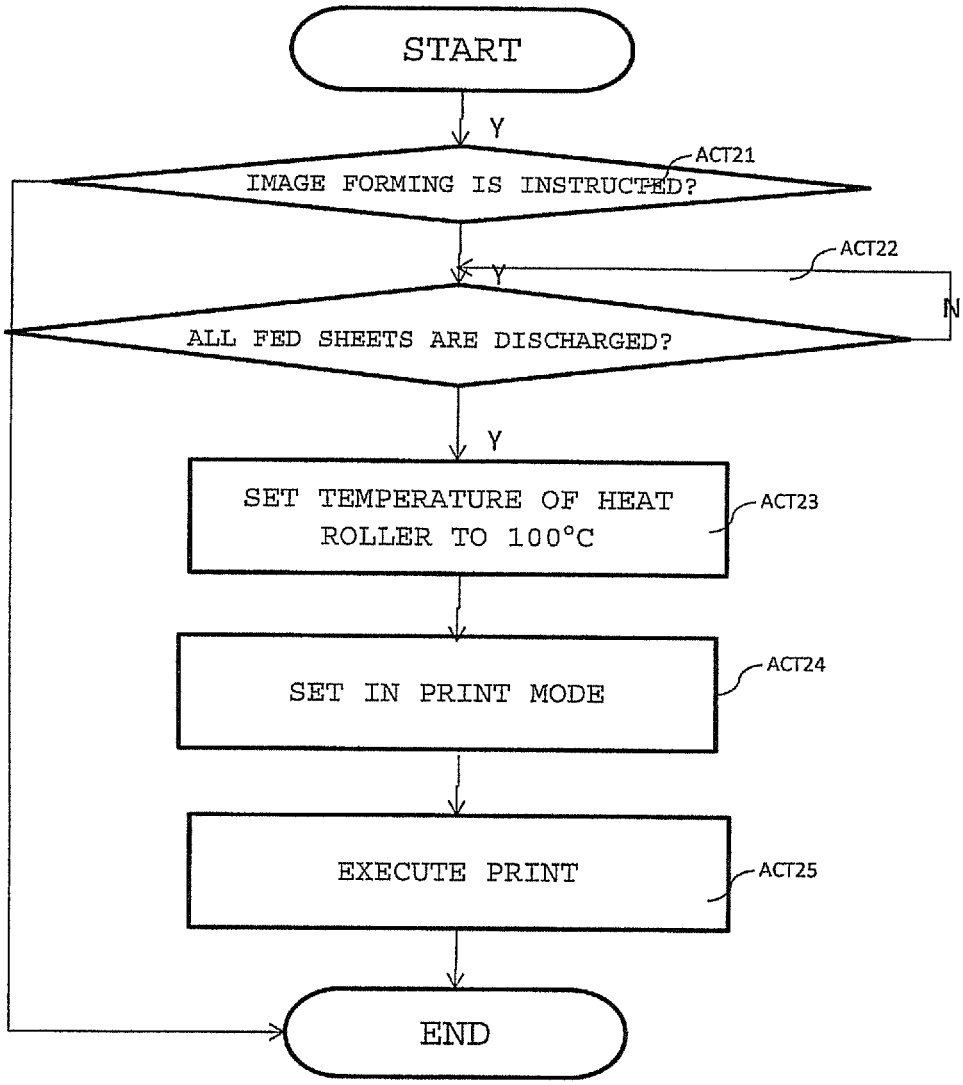
FIG. 7 is a flowchart for an image forming operation performed after the decolorizing operation.

A processing flow of processing performed by the CPU 65 when a print operation is received during a decolorizing operation is shown in FIG. 7.

If the CPU 65 receives a image forming signal or print signal during the decolorizing operation (Y in ACT 21), the CPU 65 detects, with a not-shown sheet conveyance sensor, whether all used sheets fed from the recycle paper feeding cassette 23 are discharged to the discharge section 30 of the MFP 1. If the CPU 65 determines that all the sheets are discharged (Y in ACT 22), even if sheets remain in the recycle paper feeding cassette 23, the CPU 65 ends the automatic decolorizing mode. First, the CPU 65 sets the temperature of the heat roller 51 to 100° C. (ACT 23). The CPU 65 sets the temperature of the pressurizing belt 52 to 80° C. Since the temperature of the heat roller 51 is set to 130° C. and the temperature of the pressurizing belt 52 is set to 110° C. during decolorizing, the CPU 65 waits for the temperatures of the heat roller 51 and the pressurizing belt 52 to drop. At this point, in order to quickly lower the temperature of the heat roller 51, the heat roller 51 and the pressurizing belt 52 may be spaced apart from each other. If the CPU 65 detects that the temperature of the heat roller 51 drops to 100° C. and the temperature of the pressurizing belt 52 drops to 80° C., the CPU 65 shifts to the print mode (ACT 24) and starts image formation. After finishing the image formation, as explained with reference to FIG. 6, the CPU 65 shifts to the automatic decolorizing mode again when it is detected that the predetermined idle time, for example 30 minutes, elapses.

According to this embodiment, it is possible to automatically start decolorizing process according to a state of the MFP 1. If MFP 1 is not used for predetermined time, the MFP 1 allows an increase in the temperature of the heat roller 51. Therefore, when print is frequently performed, a temperature rise of the heat roller 51 is suspended. Therefore the operability of the MFP 1 is improved. Since the MFP 1 includes the energy saving mode and performs the shift from the energy saving mode to the decolorizing mode, heating power to heat the heating and decolorizing device 5 can be reduced compared with shifting to the decolorizing mode from a power OFF mode or sleep mode.

The automatic decolorizing mode is explained above. However, the interrupt decolorizing mode and the time designated decolorizing mode can also be selected in addition to the automatic decolorizing mode.

If the interrupt decolorizing mode is selected, the CPU 65 controls mode shifting to decolorizing mode immediately after a pending job is finished. The temperature of the heat roller 51 rises to 130° C. In this case, when the print is necessary immediately after decolorizing mode, the user has to wait until the temperature of the heat roller 51 drops.

In the time designated decolorizing mode, the user designates decolorizing start time and decolorizing end time from the liquid crystal panel 104. Between the decolorizing start time and the decolorizing end time, decolorizing process is performed. It is possible to prohibit to start the decolorizing process when sheets are absent in the recycle paper feeding cassette 23.

While certain embodiments have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. An image forming apparatus comprising:

an image forming section configured to form an image on a medium with a decolorizable toner;

a fixing and decolorizing section configured to fix the image formed on the medium and to decolorize the image on the medium selectively;

a heat generating section configured to heat the fixing and decolorizing section to a first temperature during the fixing and to heat the fixing and decolorizing section to a second temperature higher than the first temperature during the decolorizing;

a count section configured to count time during which the image forming section doesn't perform an image forming after the image forming on the medium is finished through the fixing; and a control section configured to heat the fixing and decolorizing section at the second temperature after the time counted by the count section reaches a predetermined threshold time, wherein, the control section also heats the heat generating section at the first temperature or a third temperature lower than the first temperature to keep energizing the fixing and decolorizing until the time counted by the count section reaches the predetermined threshold time.

2. The apparatus according to claim 1, further comprising:

a storing section configured to store the medium having the image formed thereon with the decolorizable toner, wherein the control section feeds the medium stored in the storing section to the fixing and decolorizing section after the time counted by the count section reaches the predetermined threshold time.

3. The apparatus according to claim 2, wherein the storing section includes a detecting section configured to detect whether the medium is stored, wherein the control section prohibits the heating of the fixing and decolorizing section to the second temperature when the detecting section detects that an medium is absent in the storing section.

4. The apparatus according to claim 2, wherein the storing section includes a detecting section configured to detect whether a quantity of the media stored in the storing section is equal to or more than a predetermined threshold quantity, and wherein the control section prohibits the heating of the fixing and decolorizing section to the second temperature when the detecting section detects that the quantity of the media stored in the storing section is less than a predetermined threshold quantity.

5. The apparatus according to claim 2, wherein the storing section includes a detecting section configured to detect whether a quantity of image recording media stored in the storing section is equal to or more than a predetermined threshold quantity, and wherein the control section prohibits the heating of the fixing and decolorizing section to the second temperature earlier when the detecting section detects that the quantity of the media stored in the storing section is less than the predetermined threshold quantity than when the detecting section detects that the quantity of image recording media stored in the storing section is equal to or more than the fixed threshold quantity.

6. The apparatus according to claim 1, wherein, the apparatus includes an energy saving mode for maintaining the fixing and decolorizing section at the third temperature, and the control section cancels the energy saving mode and starts the heating of the fixing and decolorizing section with the heat generating section, after the time counted by the count section reaches the a predetermined threshold time.

7. The apparatus according to claim 1, wherein the control section stops heat generation by the heat generating section after the fixing and decolorizing section finishes the decolorizing.

8. The apparatus according to claim 1, wherein the control section heats the fixing and decolorizing section to the first temperature with the heat generating section after the fixing and decolorizing section finishes the decolorizing.

9. A method for controlling an image forming apparatus, which includes a fixing and decolorizing section, the method comprising:

forming an image on a medium with a decolorizable toner;

heating the fixing and decolorizing section to first temperature;

fixing an image on the medium with the fixing and decolorizing section heated to the first temperature;

counting time during which the image forming is not performed;

heating the fixing and decolorizing section to second temperature higher than the first temperature after the counted time reaches a predetermined threshold time; and decolorizing, with the fixing and decolorizing section, the image formed on the image recording medium with the decolorizable toner;

wherein, heating the fixing and decolorizing section at the first temperature or a third temperature lower than the first temperature to keep energizing the fixing and decolorizing until the counted time reaches the predetermined threshold time.

10. An image forming apparatus comprising:

an image forming section configured to form an image on a medium with a decolorizable toner in accordance with an image forming instruction signal;

a fixing and decolorizing section configured to fix the image formed on the medium and to decolorize the image on the medium selectively;

a heat generating section configured to heat the fixing and decolorizing section to a first temperature during the fixing and to heat the fixing and decolorizing section to a second temperature higher than the first temperature during the decolorizing;

a control section configured to heat the fixing and decolorizing section at the second temperature after no image forming instruction signal is received for a predetermined time;

wherein, the control section also heats the heat generating section at the first temperature or a third temperature lower than the first temperature to keep energizing the fixing and decolorizing until the predetermined threshold time.

* * * * *